US007568715B2

(12) United States Patent
Cooney

(10) Patent No.: US 7,568,715 B2
(45) Date of Patent: Aug. 4, 2009

(54) RECREATIONAL APPARATUS

(76) Inventor: George Cooney, 5074 Coventry St., Royal Oak, MI (US) 48073

( * ) Notice: Subject to any disclaimer, the term of this patent is extended or adjusted under 35 U.S.C. 154(b) by 358 days.

(21) Appl. No.: 11/600,542

(22) Filed: Nov. 16, 2006

(65) Prior Publication Data

US 2008/0116654 A1 May 22, 2008

(51) Int. Cl.
*A63G 25/00* (2006.01)

(52) U.S. Cl. ..... 280/206; 280/205

(58) Field of Classification Search ..... 280/205, 280/206, 207; 180/10, 21
See application file for complete search history.

(56) References Cited

U.S. PATENT DOCUMENTS

| | | | | | |
|---|---|---|---|---|---|
| 459,310 | A | | 9/1891 | Ross | |
| 521,786 | A | * | 6/1894 | Finch | 280/207 |
| 792,403 | A | | 6/1905 | Grosse | |
| 1,625,327 | A | | 4/1927 | Moore | |
| 1,673,774 | A | * | 6/1928 | Moore | 280/207 |
| 2,019,728 | A | * | 11/1935 | Ranck | 280/207 |
| 2,953,394 | A | * | 9/1960 | Anderson | 280/207 |
| 3,260,324 | A | * | 7/1966 | Suarez | 180/10 |
| 3,338,593 | A | | 8/1967 | Gehring | |
| 3,464,718 | A | * | 9/1969 | Fisher | 280/206 |
| 3,575,443 | A | | 4/1971 | Aguilar | |
| 3,622,179 | A | * | 11/1971 | Pfersick | 280/207 |
| 3,762,744 | A | * | 10/1973 | Sidlauskas | 280/207 |
| 3,777,835 | A | * | 12/1973 | Bourne | 180/10 |
| 3,905,617 | A | * | 9/1975 | Smith | 280/206 |
| 4,102,542 | A | * | 7/1978 | Pirre et al. | 280/207 |
| 4,302,006 | A | | 11/1981 | Johnson | |
| 4,364,579 | A | * | 12/1982 | Fisher | 280/206 |
| 4,401,314 | A | | 8/1983 | Zimmerman | |
| 4,436,039 | A | * | 3/1984 | Stephens, Jr. | 111/100 |
| 5,064,210 | A | * | 11/1991 | Gibbons | 280/206 |
| 5,320,372 | A | * | 6/1994 | Langen | 280/207 |
| 5,370,410 | A | * | 12/1994 | Heijman | 280/206 |
| 6,074,305 | A | | 6/2000 | Schnapp | |
| 6,368,226 | B1 | * | 4/2002 | Gibson | 472/25 |
| 7,337,862 | B1 | * | 3/2008 | Greenley et al. | 180/10 |

FOREIGN PATENT DOCUMENTS

| | | |
|---|---|---|
| DE | 10058821 | 4/2002 |
| JP | 05111547 | 5/1993 |

* cited by examiner

*Primary Examiner*—Lesley D. Morris
*Assistant Examiner*—Marc A Scharich
(74) *Attorney, Agent, or Firm*—Harness, Dickey & Pierce, P.L.C.

(57) ABSTRACT

According to various embodiments a recreational apparatus can include an outer raceway having a ground engaging portion. An inner race assembly can be rotatably engaged to and operable to rotate within the outer raceway. A footrest can be disposed on the inner race assembly. The footrest can be adapted to receive a foot of an operator and support an operator within the inner race assembly. A handle can be disposed on the inner race assembly and adapted to receive a hand of the operator. A locking portion can be disposed on the inner race assembly and operable to permit rotation of the inner race assembly in a first direction around the outer raceway and inhibit rotation of the inner race assembly in a second direction around the outer raceway.

15 Claims, 5 Drawing Sheets

RECREATIONAL APPARATUS

FIELD

The present disclosure relates generally to a recreational apparatus and more particularly to a recreational exercise vehicle.

BACKGROUND

Recreational activities have become increasingly popular in recent years. For example, many people partake in outdoor activities such as running, inline skating, skateboarding, biking and others. Sometimes a participant is interested only in recreational enjoyment. Other times a participant is interested in a certain activity to build physical strength or endurance. It would be desirable to participate in an activity that blends both of these attributes into one device.

SUMMARY

According to various embodiments a recreational apparatus can include an outer raceway having a ground engaging portion. An inner race assembly can be rotatably engaged to and operable to rotate within the outer raceway. A footrest can be disposed on the inner race assembly. The footrest can be adapted to receive a foot of an operator and support an operator within the inner race assembly. A handle can be disposed on the inner race assembly and adapted to receive a hand of the operator. A locking portion can be disposed on the inner race assembly and operable to permit rotation of the inner race assembly in a first direction around the outer raceway and inhibit rotation of the inner race assembly in a second direction around the outer raceway.

According to additional features, the locking portion can comprise a first pawl coupled to the inner race assembly and having an engaging portion engaged to the outer raceway. The engaging portion can be adapted to drag along the outer raceway in the first direction and frictionally grip the outer raceway in the second direction. The engaging portion can be comprised of elastomeric material. The apparatus can further include a second pawl. The first and second pawls can be laterally offset and engaged to respective sidewalls of the outer raceway. The ground engaging portion of the outer raceway can include a rubber tire. The rubber tire can be adapted to nest within a concave annular groove formed around an outer diameter of the outer raceway.

According to still other features, the inner race assembly can include a carriage having wheels rotatably mounted thereon and engaged to the outer raceway. The carriage can include a pair of isolators disposed thereon and laterally offset outboard from a pair of sidewalls defined on the outer raceway. The isolators can be adapted to contact at least one of the sidewalls and thereby preclude movement of the carriage in a direction transverse to the sidewalls.

BRIEF DESCRIPTION OF THE DRAWINGS

The present teachings will become more fully understood from the detailed description and the accompanying drawings, wherein.

DETAILED DESCRIPTION OF VARIOUS EMBODIMENTS

The following description of various embodiments is merely exemplary in nature and is in no way intended to limit the teachings, its application, or uses.

Figure 1:
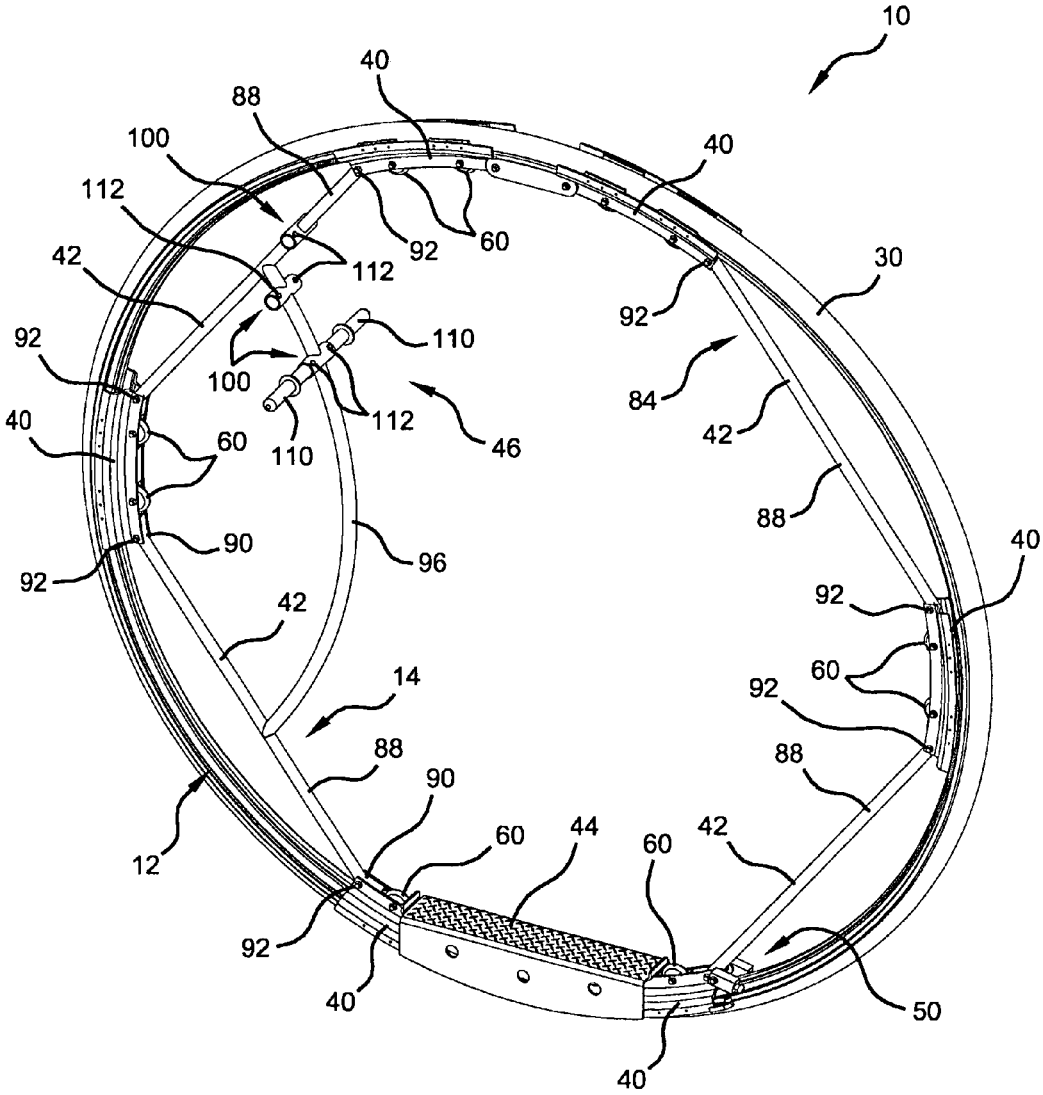
FIG. 1 is a side perspective view of the recreational apparatus having an outer raceway and an inner race assembly constructed in accordance with the present teachings.

With initial reference to FIG. 1, a recreational apparatus constructed in accordance with the present teachings is shown and generally identified at reference numeral 10. The recreational apparatus 10 may generally include an outer raceway 12 and an inner race assembly 14. As will be described in greater detail, the inner race assembly 14 may be configured to accept an operator and rotate in a first direction within the outer raceway 12 during operation.

Figure 2:
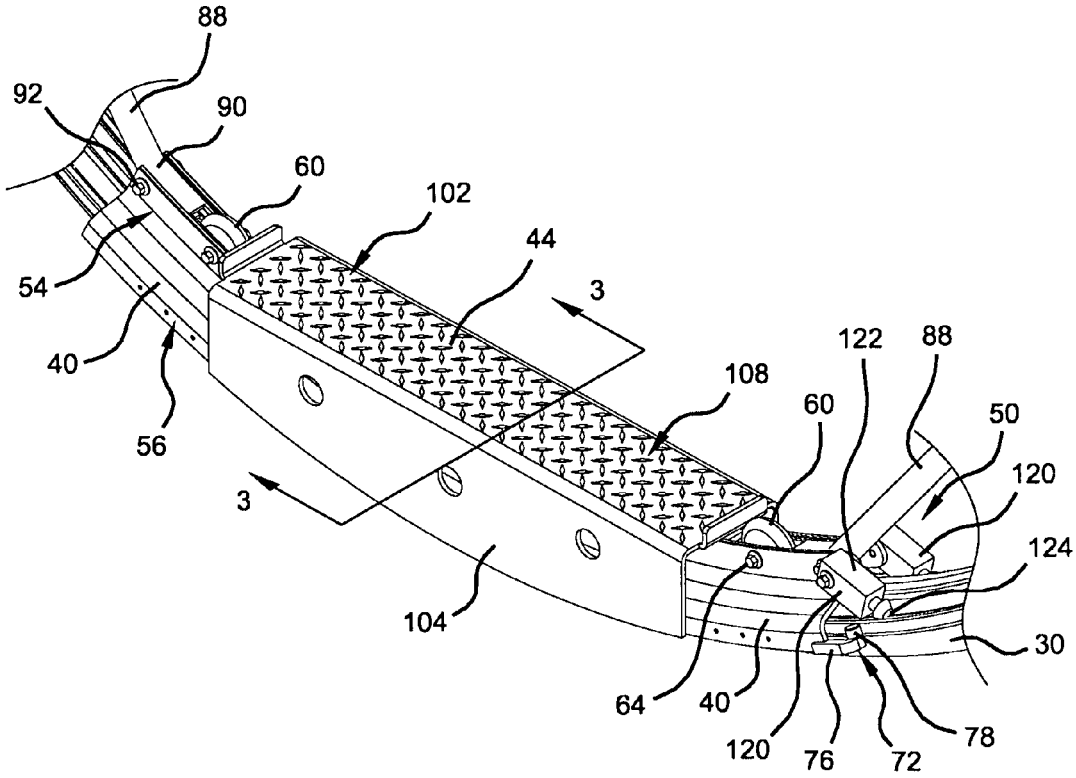
FIG. 2 is a detail perspective view of a portion of the recreational apparatus showing a foot platform operably connected to the inner race assembly.
Figure 3:
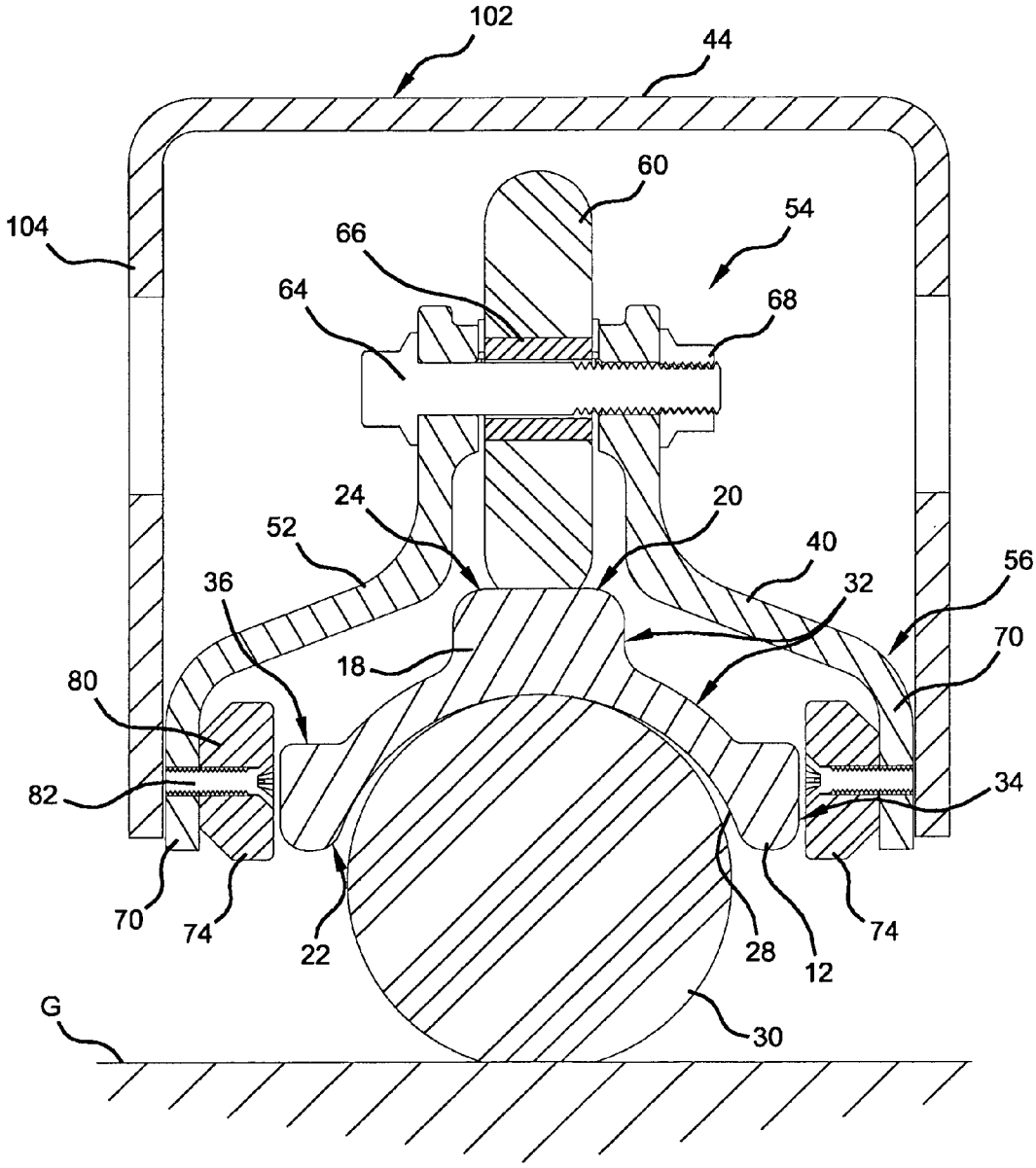
FIG. 3 is a cross-sectional view taken along line 3-3 of FIG. 2.

With continued reference to FIG. 1 and additional reference to FIGS. 2 and 3, the outer raceway 12 will be further described. The outer raceway 12 may generally include a circular body portion 18 (FIG. 3) having an inboard surface 20 and an outboard surface 22. The inboard surface 20 may define a race surface 24. The outboard surface 22 may define an annular groove 28. The annular groove 28 may be adapted to accept a tire 30 thereat. The tire 30 may be formed of resilient material, such as rubber, suitable to provide grip onto a ground surface G. The tire 30 may be solid or pneumatic. The outer raceway 12 may further define an inboard rim 32, an outboard rim 34 and a lateral rim 36 (FIG. 3). The inboard rim 32 may extend on opposite sides of the race surface 24. The outboard rim 34 may be defined proximate to the outboard surface 22. The lateral rim 36 may be located intermediate the inboard and outboard rim 32 and 34, respectively. The outer raceway 12 may be formed of rigid lightweight material such as but not limited to aluminum, plastic and composites.

With continued reference to FIGS. 1-3, the inner race assembly 14 will be described in greater detail. In general, the inner race assembly 14 may include a plurality of carriage portions 40, a plurality of link members 42, a foot platform 44, a handle portion 46 and a locking portion 50. The respective carriage portions 40 can generally define a carriage or housing 52 (FIG. 3) having an inboard portion 54 and an outboard portion 56. The inboard portion 54 can be adapted to accept and rotatably retain a plurality of wheels or rollers 60. The rollers 60 may be secured to the inboard portion 54 by fasteners 64. A bearing 66 may be disposed intermediate the rollers 60 and the respective fasteners 64. In one example, the fasteners 64 may be secured by threaded nuts 68. The rollers 60 may be formed of rubber or other suitable materials. The outboard portion 56 of the housing 52 can define radially opposing sidewalls 70. In one example, the sidewalls 70 may include isolators 72 (FIG. 2) and/or 74 (FIG. 3) attached thereon. The isolators 72 and 74 are shown as two different embodiments. In a first embodiment (FIG. 2) the isolators 72 may be disposed at ends of the carriage portions 40. The isolators 72 may generally include a body 76 having a bumper 78 disposed thereon. The bumper 78 may be adapted to engage the outboard rims 34 of the outer raceway 12 and thereby inhibit lateral movement (i.e. in a direction transverse to the inboard rim 32) of the inner race assembly 14 during operation. In a second embodiment (FIG. 3), the isolators 74 may comprise bumpers 80 securably attached to the outboard portion 56 of the carriage portions 40 such as by way of fasteners 82. Again, the bumpers 80 may be adapted to engage the outboard rims 34 of the outer raceway 12 and thereby inhibit lateral movement of the inner race assembly 14 during operation. While specifically shown as two different embodiments (i.e., isolators 72 and 74), it is appreciated that any combination of isolators 72, 74 may be arranged on any combination of carriages 40 on the inner race assembly 14.

With specific reference now to FIG. 1, the link portions 42 will be described in greater detail. In general, the link portions 42 may be alternately disposed between adjacent carriage portions 40. The link portions 42 collectively define an inner frame 84 providing structural support to the inner race assembly 14. The link members 42 may define linear rod portions 88 having angled terminal ends 90. The terminal ends 90 may be secured to respective carriage portions 40 by fasteners 92. An arcuate support 96 may be connected at opposite ends to adjacent link members 42. The arcuate support 96 may define two sets of boss portions 100 for accepting the handle portion 46 thereat as will be described. While two sets of boss portions 100 are shown, it is appreciated that additional boss portions may be formed along the arcuate support 96 for presenting various mounting configurations (i.e. at various heights) for a user for the handle portion 46. In addition, one of the link members 42 may also define a pair of boss portions 100 for accepting the handle portion 46. The link members 42 and arcuate support 96 may be formed of lightweight rigid material such as but not limited to aluminum, plastic and composites.

With reference now to FIGS. 1-3, the foot platform 44 will be described in greater detail. In general, the foot platform 44 may define a planar upper surface 102 for accepting a foot of an operator during operation. The foot platform 44 may generally define the upper surface 102 and opposing side surfaces 104. The foot platform 44 may be securably attached across a pair of carriage portions 40. The upper surface 102 may define a gripping surface 108 for facilitating traction for a user. The gripping surface 108 may be formed of any suitable method such as, but not limited to etchings across the upper surface 102 (as shown), a layer of gripping material such as grit material, elastomeric material or other materials. As can be appreciated, the foot platform 44 is adapted to rotate concurrently with the inner race assembly 14 during operation.

The handle portion 46 will now be described. The handle portion 46 may include a pair of handles 110 selectively received at a selected pair of bosses 100. Each handle 110 may define an outer diameter slightly less than a respective inner diameter of the boss portions 100. In this way, the handles 110 may be slidably inserted in the respective boss portions 100 and secured thereat. According to one example, set screws 112 may be provided for locating through apertures defined in the bosses 100 and engaging the handles 110 in a secure position. It is appreciated that other configurations may be provided for selectively securing the handles 110 to the bosses 100.

Figure 4:
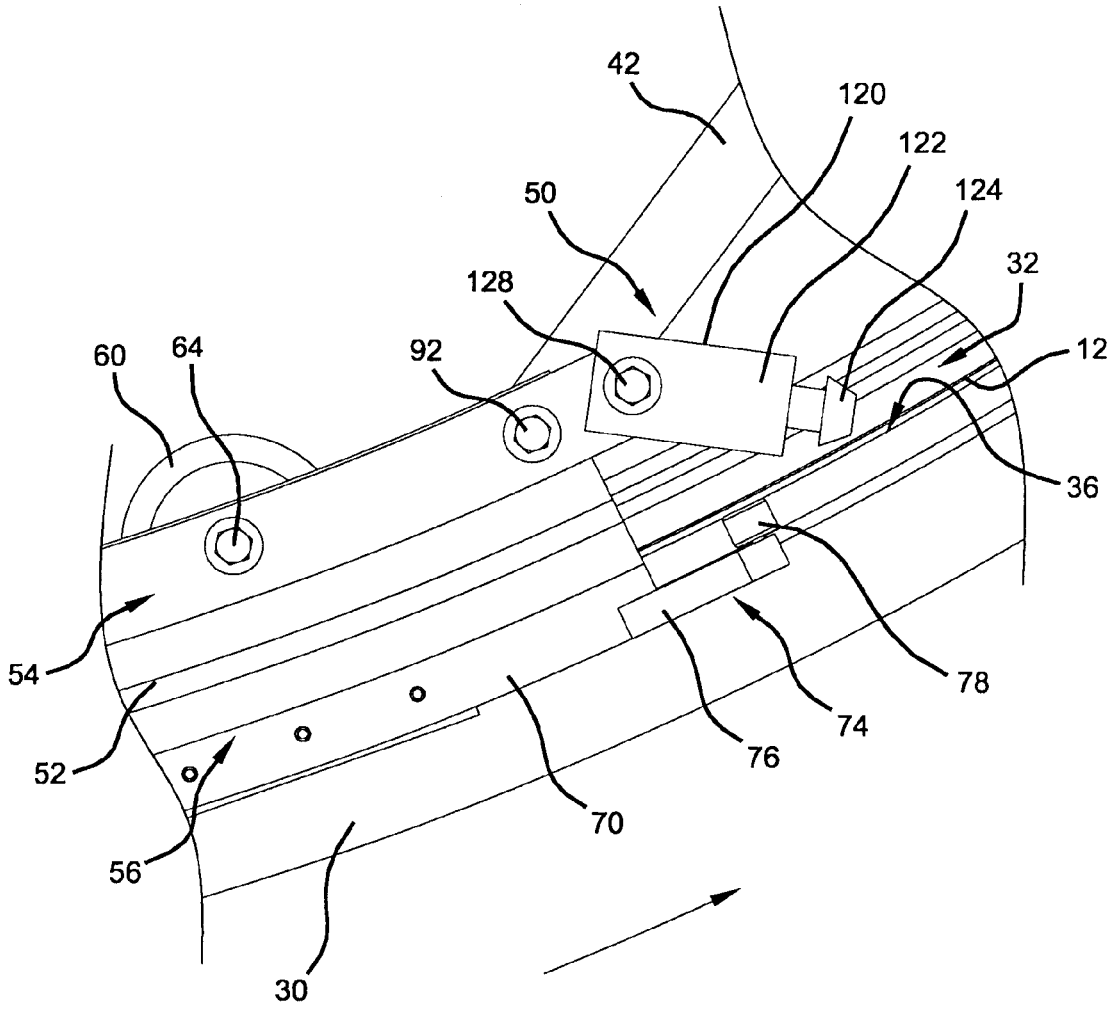
FIG. 4 is a side view of a portion of FIG. 2 illustrating a pawl slidably engaged with the outer raceway, the pawl permitting counterclockwise rotation of the outer raceway relative to the inner race assembly.

With reference now to all FIGS., the locking portion 50 will be described further. The locking portion 50 may define a pair of opposing pawls 120. Each pawl 120 may generally define a mounting portion 122 and an engaging portion 124. The mounting portion 122 may be secured at a proximal end to the carriage 40 by way of a fastener 128. The engaging portion 124 may have a conical body and extend from a distal end of the mounting portion 122. The engaging portion 124 may be adapted to slidably engage a portion of the outer raceway 12 during operation. In one example, the engaging portion 124 may slidably engage at least one of the inboard and lateral rims 32 and 36, respectively. The engaging portion 124 may be formed of resilient material such as, but not limited to rubber. As will become appreciated, the locking portion 50 can be adapted to slidably engage the outer raceway 12 during rotation of the outer raceway 12 in a counter-clockwise direction as viewed in FIG. 4. During rotation of the outer raceway 12 in the counter-clockwise direction, the locking portion 50 can be adapted to slidably engage (i.e. drag along the outer raceway 12) and permit such rotation of the outer raceway 12 relative to the inner race assembly 14.

Figure 5:
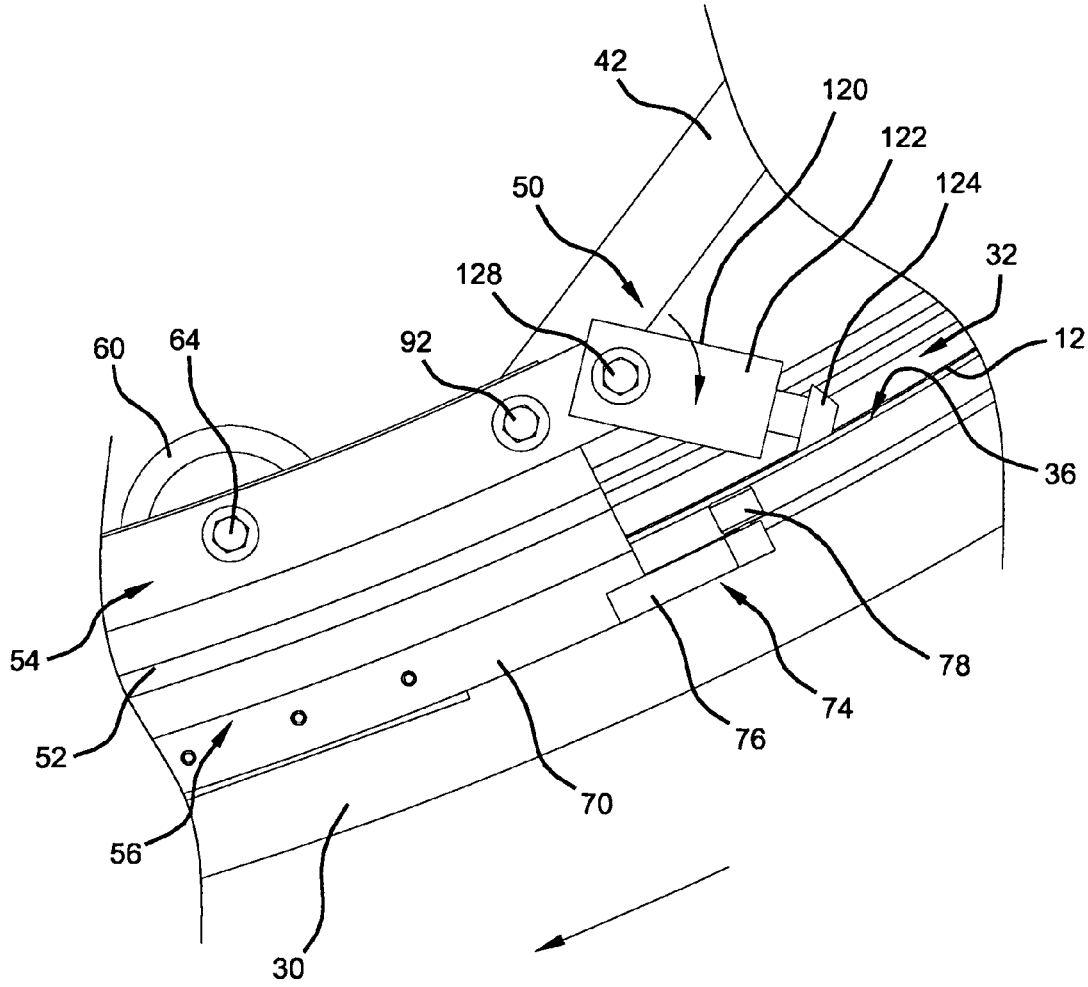
FIG. 5 is a side view of a portion of FIG. 2 illustrating the pawl securably engaged with the outer raceway, the pawl inhibiting clockwise rotation of the outer raceway relative to the inner race assembly.

During rotation of the outer raceway 12 in the opposite direction (or clockwise as viewed in FIG. 5), the locking portion 50 can be adapted to inhibit rotation of the outer raceway 12 relative to the inner race assembly 14. Explained further, in the event that clockwise rotation is imparted onto the outer raceway 12 relative to the inner race assembly 14 (or counter-clockwise rotation is imparted onto the inner race assembly 14), the respective lateral and/or inboard rim 32, 36 of the outer raceway 12 will experience a frictional gripping action from the engaging portions 124 of the pawls 120. In one example, the gripping action may influence the pawls 120 to rotate slightly clockwise (as viewed in FIG. 5) thereby encouraging additional gripping action. The gripping action may continue until relative rotation between the outer raceway 12 and the inner race assembly 14 stops.

With reference now to all FIGS., operation of the recreational apparatus 10 according to one exemplary method will now be described. An operator may stand with one or both feet on the foot platform 44 and grip with one or both hands the handle 110. As described above, the outer raceway 12 is permitted to rotate in a first direction (counter-clockwise as viewed in FIG. 1) relative to the inner race assembly 14 but inhibited from rotating in a second direction (clockwise as viewed in FIG. 1). Taking advantage of this configuration, the user may initially locate one foot onto the platform 44 and push off with the other foot on the ground G, similar to a skateboard. As can be appreciated, once enough speed has been reached, the user may place both feet onto the platform 44. Once the recreational apparatus 10 has been set in motion, the tire 30 rolls over the ground G and the rollers 60 roll over the race surface 24. Concurrently, the isolators 72, 74 assure the inner race assembly 14 is retained within the outer raceway 12.

According to another example, a user may additionally or alternatively propel the recreational apparatus 10 by pumping the handle portion 46 downward or more specifically in a counterclockwise direction (FIG. 1). Because the locking portion 50 grips the outer raceway 12 in this direction, the rotational force may be translated onto the outer raceway 12 to impart counterclockwise rotation thereon. As can be appreciated from this feature, the recreational apparatus 10 may also provide a user an upper body workout while pumping the handle 46 downward during operation.

Further areas of applicability of the present teachings will become apparent from the detailed description provided above. It should be understood that the detailed description and specific examples, while indicating various embodiments, are intended for purposes of illustration only and are not intended to limit the scope of the teachings. For example, while the locking portion has been described as opposing pawls, the same may be accomplished differently. In one example, one-way bearings may additionally or alternatively be used for the rollers (such as in the place of bearings 66).

What is claimed is:

1. A recreational apparatus comprising:

an outer raceway having a ground engaging portion;

an inner race assembly rotatably engaged to and operable to rotate within the outer raceway;

a footrest disposed on the inner race assembly and adapted to receive a foot of an operator and support an operator within the inner race assembly;

a handle disposed on the inner race assembly and adapted to receive a hand of the operator; and a locking portion including a first pawl disposed on the inner race assembly and having an elastomeric engaging portion engaged to the outer raceway, the engaging portion adapted to drag along the outer raceway in a first direction and frictionally grip the outer raceway in a second direction to permit rotation of the inner race assembly in the first direction within the outer raceway and inhibit rotation of the inner race assembly in the second direction within the outer raceway.

2. The recreational apparatus of claim 1 wherein the locking portion further includes a second pawl, wherein the first and second pawls are laterally offset and engaged to respective sidewalls of the outer raceway.

3. The recreational apparatus of claim 1 wherein the ground engaging portion of the outer raceway includes a rubber tire.

4. The recreational apparatus of claim 3 wherein the rubber tire nests within a concave annular groove formed around an outer diameter of the outer raceway.

5. The recreational apparatus of claim 1 wherein the inner race assembly includes a carriage having wheels rotatably mounted thereon and engaged to the outer raceway.

6. The recreational apparatus of claim 5 wherein the carriage includes a pair of isolators disposed thereon and laterally offset outboard from a pair of sidewalls defined on the outer raceway, the isolators adapted to contact at least one of the sidewalls and thereby preclude movement of the carriage in a direction transverse to the sidewalls.

7. The recreational apparatus of claim 6 wherein the inner race assembly includes a plurality of carriages each having wheels rotatably mounted thereon and engaged to the outer raceway.

8. The recreational apparatus of claim 1 wherein the handle is releasably secured at a plurality of locations around the inner race assembly.

9. A recreational apparatus comprising:

an outer raceway having a race surface and a ground engaging portion; and an inner race assembly rotatably engaged within the outer raceway and comprising:

a plurality of carriage portions having wheels mounted thereon and rotatably engaged to the race surface of the outer raceway;

a plurality of link members interposed between adjacent carriage portions, each link member defining a linear rod portion;

a locking portion having a first pawl disposed on the inner race assembly and having an engaging portion comprised of elastomeric material that is engaged to the outer raceway, the engaging portion adapted to drag along the outer raceway in a first direction and frictionally grip the outer raceway in a second direction to permit rotation of the inner race assembly in the first direction along the race surface and inhibit rotation of the inner race assembly in the second direction along the race surface; and an operator support member adapted to support an operator within the inner race assembly.

10. The recreational apparatus of claim 9 wherein at least one of the plurality of carriage portions include a pair of isolators disposed thereon and laterally offset outboard from a pair of sidewalls defined on the outer raceway, the isolators adapted to contact at least one of the sidewalls and thereby preclude movement of the carriage in a direction transverse to the sidewalls.

11. The recreational apparatus of claim 9 wherein the locking portion further comprises a second pawl wherein the first and second pawls are laterally offset and engaged to respective sidewalls of the outer raceway.

12. The recreational apparatus of claim 9, further comprising a handle releasably disposed on the inner race assembly.

13. The recreational apparatus of claim 12, further comprising an arcuate support member coupled to adjacent link members at opposite ends of the arcuate support member, the arcuate support member defining a first pair of boss portions adapted to receive the handle at a first location and a second pair of boss portions adapted to receive the handle at a second location.

14. A recreational apparatus comprising:

an outer raceway having a race surface and a ground engaging portion;

an inner race assembly rotatably engaged within the outer raceway and comprising:

a plurality of carriage portions having wheels mounted thereon and rotatably engaged to the race surface of the outer raceway; and a plurality of link members interposed between adjacent carriage portions, each link member defining a linear rod portion;

a handle releasably disposed on the inner race assembly;

an arcuate support member coupled to adjacent link members at opposite ends of the arcuate support member, the arcuate support member defining a first pair of boss portions adapted to receive the handle at a first location and a second pair of boss portions adapted to receive the handle at a second location; and an operator support member adapted to support an operator within the inner race assembly.

15. A recreational apparatus comprising:

an outer raceway having a race surface and a ground engaging portion; and an inner race assembly rotatably engaged within the outer raceway and comprising:

a plurality of carriage portions having wheels mounted thereon and rotatably engaged to the race surface of the outer raceway;

a plurality of link members interposed between adjacent carriage portions, each link member defining a linear rod portion;

a locking portion having a first pawl disposed on the inner race assembly and having an engaging portion engaged to the outer raceway, the engaging portion adapted to drag along the outer raceway in a first direction and frictionally grip the outer raceway in a second direction to permit rotation of the inner race assembly in the first direction along the race surface and inhibit rotation of the inner race assembly in the second direction along the race surface;

a handle releasably disposed on the inner race assembly;

an arcuate support member coupled to adjacent link members at opposite ends of the arcuate support member, the arcuate support member defining a first pair of boss portions adapted to receive the handle at a first location and a second pair of boss portions adapted to receive the handle at a second location; and an operator support member adapted to support an operator within the inner race assembly.

* * * * *